US011732389B2

(12) United States Patent
Myogi et al.

(10) Patent No.: US 11,732,389 B2
(45) Date of Patent: Aug. 22, 2023

(54) LOOM

(71) Applicant: TSUDAKOMA KOGYO KABUSHIKI KAISHA, Ishikawa-ken (JP)

(72) Inventors: Keiichi Myogi, Ishikawa-ken (JP); Daigo Yamagishi, Ishikawa-ken (JP); Koichi Tamura, Ishikawa-ken (JP); Kazuya Yama, Ishikawa-ken (JP)

(73) Assignee: TSUDAKOMA KOGYO KABUSHIKI KAISHA, Ishikawa-Ken (JP)

( * ) Notice: Subject to any disclaimer, the term of this patent is extended or adjusted under 35 U.S.C. 154(b) by 62 days.

(21) Appl. No.: 17/333,822

(22) Filed: May 28, 2021

(65) Prior Publication Data

US 2021/0381138 A1 Dec. 9, 2021

(30) Foreign Application Priority Data

Jun. 4, 2020 (JP) ..... 2020-097692

(51) Int. Cl.
*D03D 51/02* (2006.01)
*D03D 49/62* (2006.01)
(Continued)

(52) U.S. Cl.
CPC ..... *D03D 51/02* (2013.01); *D03D 49/62* (2013.01); *D03D 49/02* (2013.01); *D03D 49/54* (2013.01)

(58) Field of Classification Search
CPC ..... D03D 47/275; D03D 49/02; D03D 51/02; D03D 51/00; D03D 49/60; D03D 49/62; D03D 51/007
See application file for complete search history.

(56) References Cited

U.S. PATENT DOCUMENTS 983,550 A * 2/1911 Harrington ..... D03D 47/24 139/438
2,522,629 A * 9/1950 Mastriani ..... D03D 51/28 139/357
(Continued)

FOREIGN PATENT DOCUMENTS

CN 101922076 A 12/2010
EP 1245707 A1 10/2002
(Continued)

OTHER PUBLICATIONS

Oct. 21, 2021, European Search Report issued for related EP Application No. 21176616.7.
(Continued)

*Primary Examiner* — Robert H Muromoto, Jr.
(74) *Attorney, Agent, or Firm* — Paratus Law Group, PLLC

(57) ABSTRACT

A driving-force transmission mechanism includes a driving-force transmission shaft that is provided so as to protrude from a side wall of a side frame while extending parallel to a driving shaft within a space of the side frame and connected to a driving motor, and a transmission mechanism that connects the driving-force transmission shaft and the driving shaft, the transmission mechanism connects the driving-force transmission shaft and the driving shaft at a position on a main shaft side in a width direction of the side frame from a connection position between the driving shaft and a swing mechanism.

6 Claims, 2 Drawing Sheets

(51) Int. Cl.

| | |
|---|---|
| *D03D 49/00* | (2006.01) |
| *D03D 49/02* | (2006.01) |
| *D03D 49/54* | (2006.01) |

(56) References Cited

U.S. PATENT DOCUMENTS

| | | | | | |
|---|---|---|---|---|---|
| 2,561,416 | A * | 7/1951 | Robinson | D03D 47/44 | 139/432 |
| 2,582,761 | A * | 1/1952 | Shertz | D03D 49/24 | 139/145 |
| 2,791,242 | A * | 5/1957 | Cashion | D03D 49/70 | 139/303 |
| 2,889,855 | A * | 6/1959 | Turner | D03D 51/02 | 139/336 |
| 3,400,423 | A * | 9/1968 | Black, Jr. | D03J 1/002 | 15/312.1 |
| 3,441,058 | A * | 4/1969 | Bassing | D03D 51/02 | 139/1 R |
| 3,459,237 | A * | 8/1969 | Xaus | D03C 1/144 | 139/89 |
| 3,460,660 | A * | 8/1969 | Barrowclough | A47B 81/007 | 193/27 |
| 4,387,741 | A * | 6/1983 | Palau | D03C 1/00 | 139/66 R |
| 4,570,683 | A * | 2/1986 | Griffith | D03D 47/00 | 139/194 |
| 4,850,399 | A * | 7/1989 | Linka | D03D 47/361 | 139/50 |
| 5,007,464 | A * | 4/1991 | Gorris | D03D 47/363 | 66/219 |
| 5,020,573 | A * | 6/1991 | Debaes | D03D 47/38 | 139/453 |
| 5,259,420 | A * | 11/1993 | Foster | D03D 49/06 | 242/598.5 |
| 5,313,988 | A | 5/1994 | Bilcke et al. | | |
| 5,411,064 | A * | 5/1995 | Yamagishi | D03D 47/06 | 139/432 |
| 5,423,354 | A * | 6/1995 | Herrlein | D03D 39/226 | 139/26 |
| 6,247,503 | B1 * | 6/2001 | Shaw | D03D 51/02 | 139/1 R |
| 7,478,997 | B2 * | 1/2009 | Ishida | F04B 39/126 | 417/372 |
| 2004/0226257 | A1 * | 11/2004 | Jaeger | B23Q 1/01 | 52/749.1 |
| 2007/0220925 | A1 * | 9/2007 | Lonati | D04B 27/08 | 66/204 |
| 2009/0088035 | A1 * | 4/2009 | Gonzalez | B63H 16/12 | 440/105 |
| 2019/0145658 | A1 * | 5/2019 | Hodgkinson | B05B 7/22 | 392/478 |
| 2021/0332508 | A1 * | 10/2021 | Myogi | D03D 49/02 | |
| 2021/0381137 | A1 * | 12/2021 | Myogi | D03D 47/275 | |
| 2021/0381138 | A1 * | 12/2021 | Myogi | D03D 49/62 | |
| 2021/0381139 | A1 * | 12/2021 | Myogi | D03D 51/02 | |
| 2022/0098765 | A1 * | 3/2022 | Myogi | D03C 9/02 | |
| 2022/0098766 | A1 * | 3/2022 | Myogi | D03D 49/02 | |
| 2022/0160148 | A1 * | 5/2022 | Tegel | A47F 7/0243 | |
| 2022/0195641 | A1 * | 6/2022 | Porte | D03C 3/20 | |

FOREIGN PATENT DOCUMENTS

| | | | |
|---|---|---|---|
| EP | 1600542 | A2 | 11/2005 |
| GB | 1263519 | A | 2/1972 |
| JP | H05-156551 | A | 6/1993 |
| JP | H09-078405 | A | 3/1997 |
| JP | 2004-107838 | A | 4/2004 |

OTHER PUBLICATIONS

Apr. 18, 2023, Indian Office Action issued for related IN Application No. 202144023771.

* cited by examiner

LOOM

CROSS-REFERENCE TO RELATED APPLICATION

The present application claims priority from Japanese Patent Application No. 2020-097692, filed on Jun. 4, 2020, the entire subject matter of which is incorporated herein by reference.

BACKGROUND OF THE INVENTION

Field of the Invention

The present invention relates to a loom including a driving shaft to which a main shaft of the loom is connected and to which a swing shaft for driving a reed to swing is connected via a swing mechanism, a driving motor to which the driving shaft is connected via a driving-force transmission mechanism to rotationally drive the driving shaft, a braking device for braking the main shaft connected to the driving shaft, and a housing-shaped side frame that accommodates the driving shaft and the swing shaft in an orientation in which each axial direction of the driving shaft and the swing shaft matches with a width direction.

Background Art

In a loom, a frame includes a pair of side frames, and the side frames are connected by a plurality of beam materials. Further, the loom includes a driving motor as a main driving source, and is configured to drive the main shaft by the driving motor. The driving motor is provided on one side frame side of the pair of side frames. Each side frame has a housing shape and has a space inside thereof.

A driving shaft to which the main shaft is connected at one end thereof is accommodated in the one side frame. The driving shaft is rotationally driven by the driving motor, so that the main shaft connected to the driving shaft is rotationally driven. The rotation of the driving shaft is also for driving the reed to swing. Specifically, a swing shaft for driving the reed to swing is also accommodated in the one side frame, and the swing shaft is connected to the driving shaft via a swing mechanism such as a cam mechanism and a crank mechanism. As described above, the loom is configured such that the swing shaft is swing-driven as the driving shaft is rotationally driven, whereby the reed is driven to swing.

As described above, for example, the configuration (driving-force transmission mechanism) that connects the driving shaft and the driving motor for rotationally driving the driving shaft by the driving motor is disclosed in JP-A-2004-107838. In the configuration disclosed in JP-A-2004-107838, the driving shaft is provided such that an end (the other end) opposite to one end to which the main shaft is connected protrudes from the outer side wall of the side frame.

Although there is no description in JP-A-2004-107838, in a general loom, the driving motor for rotationally driving the driving shaft is provided in a form of being supported by a bracket attached to the side frame or the like on the outside of the side frame which accommodates the driving shaft. The driving motor and the driving shaft are connected by, for example, a pulley attached to each of an output shaft of the driving motor and the other end of the driving shaft, and a timing belt hung on both pulleys. The loom includes a braking device (for example, an electromagnetic brake) for braking the main shaft connected to the driving shaft. In general, the braking device is connected to the other end of the driving shaft and is provided to apply a brake to the main shaft by apply a brake to the driving shaft.

As described above, the driving shaft is connected to the main shaft at one end thereof and to the swing mechanism at an intermediate portion thereof. A device (for example, an opening device) using the main shaft as a driving source is connected to the main shaft, and a beating device is connected to the swing mechanism. Therefore, when the driving shaft is rotationally driven by the driving motor, a load for driving those devices (especially at the start of driving) acts on the driving shaft as rotational resistance at a position where the main shaft and the swing mechanism are connected.

Therefore, in the configuration in JP-A-2004-107838, all of the rotational resistance described above is applied to a portion (=entire driving shaft) of a shaft end side (one end side) with respect to a connection position (restraint point) connected to a driving motor side (driving-force transmission mechanism) in the driving shaft. As a result, a large twist may occur in the driving shaft. When such a large twist occurs, as described above, a phase of each device connected to the driving shaft is in a delayed state as compared with a rotational phase of the driving motor for rotationally driving the driving shaft. Therefore, beating timing, opening timing, or the like is also deviated, and as a result, the weaving is adversely affected.

SUMMARY OF THE INVENTION

Therefore, an object of the present invention is to provide a structure of a loom in which a deviation of a phase can be reduced in a device connected to a driving shaft by configuring a driving-force transmission mechanism that transmits rotation driving motor to the driving shaft to reduce a twist of the driving shaft as small as possible.

To achieve the above object, the present invention provides the loom as described above, in which the driving-force transmission mechanism includes a driving-force transmission shaft that is provided so as to protrude from a side wall of a side frame while extending parallel to the driving shaft within a space of the side frame and connected to the driving motor, and a transmission mechanism that connects the driving-force transmission shaft and the driving shaft. The transmission mechanism connects the driving-force transmission shaft and the driving shaft at a position on a main shaft side in a width direction of the side frame from a connection position between the driving shaft and the swing mechanism.

In such a loom according to the present invention, the transmission mechanism may be a gear train including a driving gear attached to the driving-force transmission shaft and a driven gear attached to the driving shaft. The braking device may be connected to the driving-force transmission shaft to apply a brake to the driving shaft via the driving-force transmission shaft. The driving shaft may be a crank-shaped shaft formed as an eccentric portion of which an intermediate portion is eccentric with respect to both side portions, and the swing mechanism may be connected to the eccentric portion.

According to the loom according to the present invention, the driving-force transmission mechanism is configured such that the connection position (restraint point) between the driving-force transmission shaft connected to the driving motor and the driving shaft is on the main shaft side with respect to the connection position with the swing mechanism in the driving shaft. Therefore, as described above, the rotational resistance acting on the driving shaft at two locations acts at one location on each portion on both shaft end sides (one end side and the other end side) with respect to the restraint point in the driving shaft. Therefore, according to the loom of the present invention configured as described above, the rotational resistance acting on the portion of the driving shaft on the shaft end side from the restraint point is smaller than that of the configuration of the related art. Therefore, the twist of the driving shaft is also smaller than that of the configuration of the related art. Thereby, the above-mentioned phase deviation due to the twist of the driving shaft can be reduced.

In such a loom according to the present invention, the transmission mechanism that connects the driving shaft and the driving-force transmission shaft is the gear train, so that the driving-force transmission mechanism configured as described above is advantageous in terms of maintenance. Specifically, as the configuration of the transmission mechanism, it is conceivable that the transmission mechanism is connected via a pulley and a timing belt. However, in that case, an operation such as adjusting the tension of the timing belt is required. On the other hand, by using the gear train as the transmission mechanism, such an operation is not required. Therefore, according to the configuration, the driving-force transmission mechanism is advantageous in terms of maintenance.

In the loom according to the present invention described above, the braking device may be connected to the driving-force transmission shaft to apply a brake to the driving-force transmission shaft connected to the driving shaft. Therefore, the twist of the driving shaft can also be reduced when applying the brake to the main shaft by the braking device.

Specifically, as described above, when applying the brake to the driving shaft to apply the brake to the main shaft, similar to the rotational resistance described above, the load (inertia force) for stopping the operation of the driving shaft and the device connected to the main shaft acts on the driving shaft at the connection position between the driving shaft, the main shaft, and the swing mechanism. Therefore, as described above, by adopting a loom configuration that applies the brake to the driving-force transmission shaft connected to the driving shaft, the load applied to the driving shaft during braking is reduced, and the twist of the driving shaft also becomes small compared with that of the configuration of the related art. The twist of the driving shaft during braking is reduced so that the load applied on the bearing supporting the driving shaft due to the twist of the driving shaft is also reduced. As a result, damage of the bearing can be prevented as much as possible.

As the swing mechanism in the loom, as described above, there are a cam mechanism and a crank mechanism, but it is more effective that the present invention is applied to the loom in which the driving shaft is the crank-shaped shaft, that is, the swing mechanism is the crank mechanism. Specifically, in a case where the crank mechanism is adopted as the swing mechanism, since the driving shaft is the crank-shaped shaft having the eccentric portion, the shaft is likely to be twisted by the load (rotational resistance) applied to the driving shaft due to the swing driving of the reed compared with that of a case of the cam mechanism in which the driving shaft is a shaft having no eccentric portion. Therefore, the loom in which the swing mechanism is the crank mechanism is more effective in applying the present invention.

DETAILED DESCRIPTION OF THE INVENTION

Figure 1:
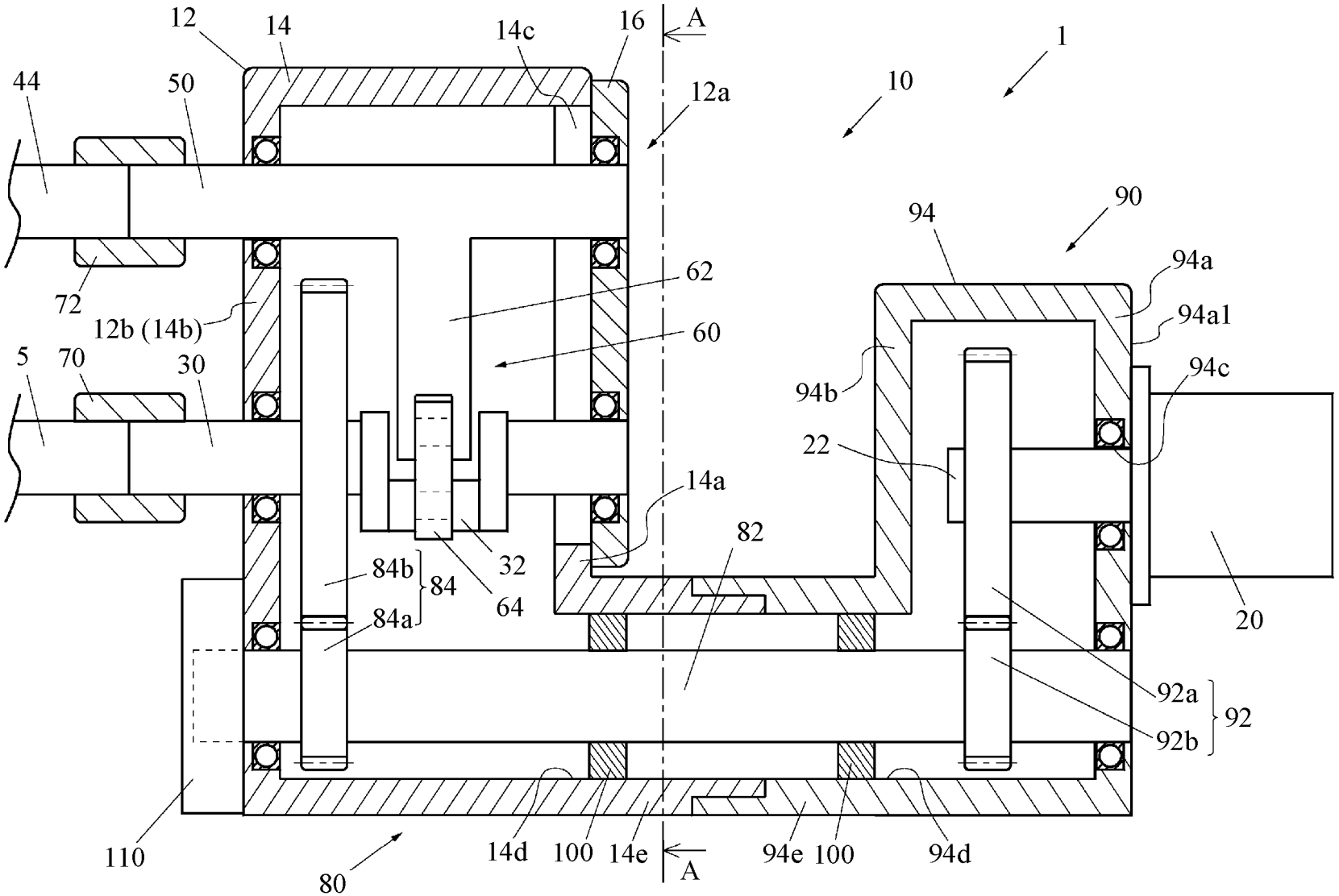
FIG. 1 is a front sectional view of a loom 1 according to an embodiment of the present invention.
Figure 2:
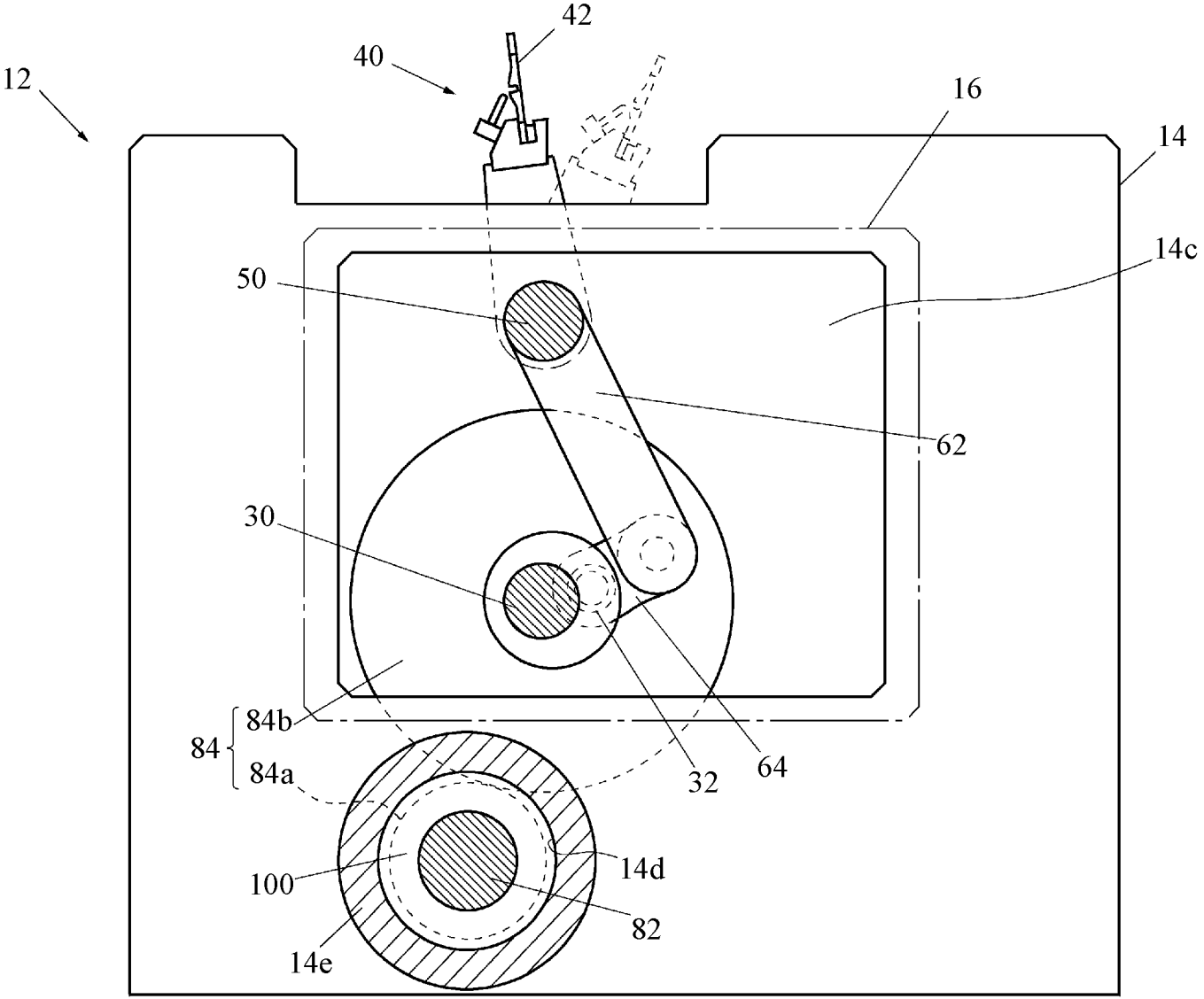
FIG. 2 is a sectional view which is taken along line A-A of FIG. 1.

Hereinafter, an embodiment (example) of a loom to which the present invention is applied will be described with reference to FIGS. 1 and 2.

In a loom 1, a frame 10 includes a pair of housing-shaped side frames 12 and 12, and the side frames 12 are connected by a plurality of beam materials. The loom 1 includes a driving motor 20, and is configured to drive a main shaft 5 of the loom 1 by the driving motor 20. The driving motor 20 is provided on one side frame 12 (hereinafter, referred to as "driving-side frame") side of the pair of side frames 12 and 12.

The driving-side frame 12 is configured of a frame body 14 that is a main portion, and a frame cover 16 attached to the frame body 14. Specifically, the frame body 14 is formed in a housing shape having a space therein, and a portion (portion corresponding to a swing mechanism 60 or the like described later in a width direction) in a side wall (outer wall portion) 14*a*, which is an outside in the width direction of the loom 1, is open. The frame cover 16 is a member formed in a plate shape, and has a size capable of covering an opened portion (opening portion) 14*c* of the frame body 14. The driving-side frame 12 is configured such that the frame cover 16 is attached to the frame body 14 in a form of covering the opening portion 14*c*. Therefore, the side wall (outer wall) 12*a* of the driving-side frame 12 that is the outside in the width direction is configured of the outer wall portion 14*a* of the frame body 14 and the frame cover 16 that covers the opening portion 14*c* thereof. The frame cover 16 is attached to the frame body 14 by using screw members (not illustrated) such as bolts, and the frame cover 16 can be attached or detached to or from the frame body 14.

The loom 1 includes a driving shaft 30 which is interposed between a driving motor 20 and a main shaft 5, is rotationally driven by the driving motor 20, and rotationally drives the main shaft 5. The loom 1 includes a swing shall 50 for driving a locking shaft 44 to swing in a beating device 40, and a swing mechanism 60 for connecting the swing shaft 50 and the driving shaft 30. The present example is an example in which a crank mechanism is adopted as the swing mechanism 60. The driving shaft 30, the swing shaft 50, and the swing mechanism 60 are disposed to be located within a range of the opening portion 14*c* in the driving-side frame 12 as viewed in the width direction, and are accommodated in the space within the driving-side frame 12. Details of each configuration in such a loom 1 are as follows.

The driving shaft 30 is formed as a shaft having a dimension (length dimension) in an axial direction, which is larger than a dimension of the driving-side frame 12 in the width direction. However, the driving shaft 30 is a crank-shaped shaft formed as an eccentric portion 32 of which an intermediate portion is eccentric with respect to portions of both sides (both-side portions). The driving shaft 30 is rotatably supported by both side walls 12*a* and 12*b* of the driving-side frame 12 via bearings in an orientation in which the axial direction matches with the width direction, and is accommodated in the driving-side frame 12 in such a form.

The support position is located such that the driving shaft 30 is located below an intermediate portion in the opening portion 14*c* in the frame body 14 when the driving-side frame 12 is viewed in the width direction. The driving shaft 30 is supported by the frame cover 16 at one end thereof in one end side. Therefore, the driving shaft 30 is in a state where a portion including the other end is provided in a form of protruding, on the other end side, from an inner wall (inside wall portion) 14*b* of the frame body 14 in the width direction. The driving shall 30 is supported by the inner wall portion of the frame body 14 at a portion on the driving-side frame 12 side from the protruding portion. The main shaft 5 is connected to the other end of the driving shaft 30 by a coupling member 70.

Similar to the driving shaft 30, the swing shaft 50 is formed as a shaft of which a dimension is larger than the dimension of the driving-side frame 12 in the width direction. Similar to the driving shaft 30, the swing shaft 50 is supported by the both side walls 12*a* and 12*b* of the driving-side frame 12 via bearings in the orientation parallel to the driving shaft 30, and is accommodated in the driving-side frame 12. Similar to the driving shaft 30, the support position is a position within the range of the opening portion 14*c* in the frame body 14 when the driving-side frame 12 is viewed in the width direction, and is a position above the driving shaft 30. The swing shaft 50 is also supported by the frame cover 16 at one end thereof, a portion including the other end is provided so as to protrude from the inner wall portion 14*b* of the fame body 14, and is supported by the inner wall portion 14*b* of the frame body 14 at the other end side thereof. A locking shaft 44 that supports the reed 42 is connected to the other end of the swing shaft 50 by a coupling member 72.

As described above, the swing mechanism 60 is the crank mechanism and includes a swing arm 62 which is provided so as not to rotate relative to the swing shaft 50, and a connection lever 64 which is a link for connecting the swing arm 62 and the eccentric portion 32 of the driving shaft 30. In the illustrated example, the swing shaft 50 and the swing arm 62 are integrally formed. The connection lever 64 is relatively rotatably connected to the swing arm 62 and the driving shaft 30 (eccentric portion 32). In the swing mechanism 60, the driving shaft 30 is rotationally driven and the eccentric portion 32 is rotationally moved at a position eccentric from a shaft center of both side portions, and thereby the swing arm 62 (swing shaft 50) connected to the eccentric portion 32 via the connection lever 64 is driven to swing. Therefore, in that configuration, a part of the driving shaft 30 also functions as the swing mechanism 60. As described above, the swing shaft 50 is driven to swing, and thereby the locking shaft 44 connected to the swing shaft 50 and the reed 42 supported by the locking shaft 44 move to swing, and the beating operation is performed.

In the loom 1 described above, the loom 1 includes a driving-force transmission mechanism 80 that connects the driving shaft 30 and the driving motor 20. Therefore, the driving shaft 30 connected to the main shaft 5 is rotationally driven by the driving motor 20. In the present invention, the driving-force transmission mechanism 80 is configured to include a driving-force transmission shaft 82 connected to the driving motor 20 and a transmission mechanism 84 connecting the driving-force transmission shaft 82 and the driving shaft 30. The present example is an example in which the transmission mechanism 84 is a gear train and the gear train is accommodated in the driving-side frame 12. Details of the driving-force transmission mechanism 80 of the present example are as follows.

The driving-force transmission shaft 82 is formed as a shaft of which a dimension (length dimension) in the axial direction is larger than the dimension of the driving-side frame 12 in the width direction and is larger than the length dimension of the driving shaft 30. The driving-force transmission shaft 82 is provided to be supported by the inner wall 12*b* of the driving-side frame 12 via a bearing on one end side thereof in the orientation parallel to the driving shaft 30, and penetrate the outer wall portion 14*a* (outer wall 12*a* of the driving-side frame 12) of the frame body 14, and the other end thereof is located on the outside of the outer wall portion 14*a*. Therefore, the driving-force transmission shaft 82 is in a state where a portion between the portion supported by the bearing and the outer wall portion 14*a* is accommodated within the driving-side frame 12. However, as described above, although the driving-force transmission shaft 82 is supported by the inner wall 12*b* on the one end side, the driving-force transmission shaft 82 also protrudes from the inner wall 12*b* so that the one end is located on the outside of the inner wall 12*b*. The driving-force transmission shaft 82 provided as described above is connected to the driving shaft 30 by the transmission mechanism 84 within the driving-side frame 12.

The support position of the driving-force transmission shaft 82 is a position outside the range of the opening portion 14*c* in the frame body 14, and is a position separated downward from the driving shaft 30. In the outer wall portion 14*a* of the frame body 14, a through hole 14*d* is formed at a position corresponding to the support position to allow the driving-force transmission shaft 82 to penetrate as described above.

In the present example, the transmission mechanism 84 is configured as a gear train including two gears accommodated within the driving-side frame 12. Specifically, the transmission mechanism 84 is configured of a driving gear 84*a* attached so as not to rotate relative to the driving-force transmission shaft 82, and a driven gear 84*b* that meshes with the driving gear 84*a* and is attached so as not to rotate relative to the driving shaft 30. However, the position where the driving gear 84*a* and the driven gear 84*b* are attached to each shaft is a position on the inner wall 12*b* side of the driving-side frame 12 in the width direction from the connection position between the driving shaft 30 (eccentric portion 32) and the swing mechanism 60 (connection lever 64). That is, in the present example, the driving-force transmission shaft 82 and the driving shaft 30 are connected at a position on the inner wall 12*b* side of the driving-side frame 12 in the width direction from the connection position between the driving shaft 30 and the swing mechanism 60.

The driving-force transmission shaft 82 is a driving mechanism 90 for rotationally driving the driving-force transmission shaft 82 on the other end side, and is connected to the driving mechanism 90 including the driving motor 20. In addition to the driving motor 20, the driving mechanism 90 includes a driving gear train 92 that connects the output shaft 22 of the driving motor 20 and the driving-force transmission shaft 82. The driving mechanism 90 is configured to have a housing-shaped driving box 94 as a base, the driving motor 20 is attached to the outer surface of the driving box 94, and the driving gear train 92 is accommodated within the driving box 94.

In the driving box 94, the driving motor 20 is attached to an outer surface 94*a*1 of one side wall 94*a* of the pair of side walls 94*a* and 94*b* facing each other, and the both side walls 94*a* and 94*b* are provided to be parallel to the outer wall 12*a* of the driving-side frame 12. The driving box 94 is provided to overlap the driving-side frame 12 in the back and forth direction of the loom 1. As described above, since the driving-force transmission shaft 82 protruding from the driving-side frame 12 is connected to the driving gear train 92 accommodated within the driving box 94, the driving-force transmission shaft 82 penetrates the other side wall

94*b* of the pair of side walls 94*a* and 94*b* in the driving box 94, and the portion of the other end side is located within the driving box 94 (accommodated in the driving box 94). Therefore, a through hole 94*d* that allows the penetration of the driving-force transmission shaft 82 is formed on the other side wall 94*b* in the driving box 94.

As described above, the driving-force transmission shaft 82 protruding from the driving-side frame 12 is supported by one side wall 94*a* in the driving box 94 via a bearing at the other end. However, the driving box 94 is provided such that the other side wall 94*b* through which the driving-force transmission shaft 82 penetrates is separated from the driving-side frame 12.

The driving motor 20 is attached to the driving box 94 by bolts or the like (not illustrated) such that the output shaft 22 is oriented toward the driving-side frame 12 side at a position separated upward with respect to the driving-force transmission shaft 82 supported as described above. A through hole 94*c* is formed on one side wall 94*a* in the driving box 94 to which the driving motor 20 is attached to allow the output shaft 22 of the driving motor 20 to penetrate at the attachment position. Therefore, as described above, in a state where the driving motor 20 is attached to the driving box 94, the output shaft 22 extends within the driving box 94 in the width direction and exists to be parallel to the driving-force transmission shaft 82. The output shaft 22 is connected to a portion of the driving-force transmission shaft 82 on the portion of the other end side of via the driving gear train 92 within the driving box 94.

Similar to the gear train 84 connecting the driving shaft 30 and the driving-force transmission shaft 82, the driving gear train 92 is configured of two gears. Specifically, the driving gear train 92 is configured of a driving gear 92*a* that is attached so as not to rotate relative to the output shaft 22 of the driving motor 20, and a driven gear 92*b* that meshes with the driving gear 92*a* and is attached so as not to rotate relative to the driving-force transmission shaft 82.

The loom 1 includes a braking device (for example, an electromagnetic brake) 110 for applying a brake to the main shaft 5 connected to the driving shaft 30. The braking device 110 is provided so as to be connected to the driving-force transmission shaft 82 at a position inside from the driving-side frame 12 in the width direction. Therefore, the driving-force transmission shaft 82 is provided such that one end thereof protrudes from the inner wall 12*b* of the driving-side frame 12 for connection with the braking device 110. The braking device 110 is attached to the inner wall 12*b* of the driving-side frame 12 and is connected to one end of the protruding driving-force transmission shaft 82. According to such a configuration, when the loom 1 (main shaft 5) is braked, the driving-force transmission shaft 82 is braked by the braking device 110, so that the brake is applied to the driving shaft 30 connected via transmission mechanism 84 as described above. As a result, the rotation of the main shaft 5 which is connected to the driving shaft 30 is stopped.

In the illustrated example, the frame body 14 has a protruding portion 14*e* formed to protrude from the outer wall portion 14*a* toward the driving box 94 side around the through hole 14*d* in the outer wall portion 14*a*. On the other hand, the driving box 94 also has a protruding portion 94*e* formed to protrude from the other side wall 94*b* toward the driving-side frame 12 side around the through hole 94*d* in the other side wall 94*b*. The frame body 14 and the driving box 94 are connected such that the both protruding portions 14*e* and 94*e* are fitted to each other. In spaces inside the protruding portions 14*e* and 94*e*, oil seals 100 are provided between inner peripheral surfaces of the protruding portions 14*e* and 94*e*, and the driving-force transmission shaft 82.

According to the loom 1 of the present example configured as described above, the driving-force transmission shaft 82 in the driving-force transmission mechanism 80, which transmits the rotation of the driving motor 20 (output shaft 22) to the main shaft 5, and is connected to the main shaft 5 and rotationally driven by the driving motor 20, is configured such that the one end side portion is accommodated in the driving-side frame 12 and connected to the driving shaft 30 within the driving-side frame 12.

The connection position between the driving-force transmission shaft 82 and the driving shaft 30 is the position on the inner wall 12*b* side of the driving-side frame 12 which is the main shaft 5 side (connection position side between the driving shaft 30 and the main shaft 5) with respect to the connection position between the driving shaft 30 and the swing mechanism 60 in the width direction. Therefore, on the driving shaft 30, the connection position with the driving-force transmission mechanism 80 (transmission mechanism 84) becomes a restraint point of the driving shaft 30. In the connection position with the swing mechanism 60 and the connection position with the main shaft 5, one (swing mechanism 60 side) is located on one shaft end side (one end side) with respect to the restraint point, and the other (main shaft 5 side) is located on the other shaft end side (the other end side). Therefore, the rotational resistance acting on the driving shaft 30 at the connection position with the swing mechanism 60 and the connection position with the main shaft 5 acts at one place on each of the both end sides (one end side and the other end side) of the shaft with respect to the restraint point.

According to the loom 1 configured as described above, each amount of twist at the connection portion with the swing mechanism 60 and the connection portion with the main shaft 5 in the driving shaft 30 is reduced compared with that of the configuration of the related art in which all the rotational resistance acts on one end side of the shaft with respect to the restraint point. As a result, the phase deviation occurred due to the twist of the driving shaft 30 in the device connected to the driving shaft 30 becomes small compared with that of the configuration of the related art.

In the loom 1, a braking device 110 is provided to apply a brake to the driving-force transmission shaft 82 connected to the driving shaft 30. Therefore, according to the configuration, when the main shaft 5 is braked, the load (inertia force) applied to the connection position between the main shaft 5 and the swing mechanism 60 in the driving shaft 30 acts at one place on each of the both end sides of the shaft with respect to the restraint point similar to the rotational resistance described above. Therefore, the amount of twist of the driving shaft 30 due to the load when the main shaft 5 is braked becomes small similar to the amount of twist due to the rotational resistance described above, and damage of the bearing due to the twist of the driving shaft 30 during braking can be prevented as much as possible.

In the above, one embodiment (hereinafter, referred to as "the above example") of the loom to which the present invention is applied is described. However, the present invention is not limited to the configuration described in the above example, and can be implemented in other embodiments (modified examples) as described below.

(1) Regarding the transmission mechanism that connects the driving shaft and the driving-force transmission shall, the transmission mechanism is not limited to the gear train configured of two gears of the driving gear 84*a* and the driven gear 84*b* which are accommodated within the driving-side frame 12 as in the above example. For example, the transmission mechanism may be one that is also configured of the same gear train, or may be a gear train that is configured of three or more gears. The transmission mechanism is not limited to one configured of the gear train, and may be configured to connect a pulley attached to the driving shaft and a pulley attached to the driving-force transmission shaft with a timing belt.

(2) Regarding the position where the driving shaft and the driving-force transmission shaft are connected by the transmission mechanism, the connection position (restraint point) is not limited to the position within the driving-side frame as in the above example. For example, after forming the driving-force transmission shaft as an shaft so as to protrude to the main shaft side from the inner wall of the driving-side frame, the driving shaft and the driving-force transmission shaft may be connected at a position (position on the main shaft side in the width direction from the inner wall of the driving-side frame) other than driving-side frame.

(3) Regarding the position where the braking device is provided, in the above example, the braking device 110 is provided inside the driving-side frame 12 in the width direction in a form of connecting to the driving-force transmission shaft 82. However, in the present invention, the position where the braking device is provided is not limited to the inside and may also be outside the driving-side frame even in a case of being connected to the driving-force transmission shaft. In that case, the braking device may be attached to the outer wall of the driving-side frame or attached to the side wall of the driving box.

The present invention is not limited to the configuration in which the braking device in the form of connecting to the driving-force transmission shaft is provided, and the braking device may be provided in a form of connecting to the driving shaft. For the disposition of the braking device, the driving shaft and the driving-force transmission shaft may be separate shafts (brake shaft), the brake shaft connected to the driving shaft or the driving-force transmission shaft via a gear train or the like may be provided within the side frame, and a braking device may be provided to be connected to the brake shaft.

(4) Regarding the swing mechanism, the above example is an example of the present invention applied to the loom in which the crank mechanism is adopted as the swing mechanism 60. In the above example, the swing arm 62 in the swing mechanism 60 is integrally formed with the swing shaft 50. However, even in the crank mechanism as in the above example, the swing mechanism may be configured such that the swing arm and the swing shaft are formed as separate members, and both are connected so as not to rotate relative to each other. The swing mechanism is not limited to the crank mechanism as in the above example, and may be a cam mechanism. In that case, the shaft to which the cam is attached becomes the driving shaft in the present invention.

Further, the present invention is not limited to the above-described embodiments, and various modifications can be made without departing from the gist of tine present invention.

What is claimed is:

1. A loom comprising:

a driving shaft to which a main shaft of the loom is connected and to which a swing shaft for driving a reed to swing is connected via a swing mechanism;

a driving motor to which the driving shaft is connected via a driving-force transmission mechanism to rotationally drive the driving shaft;

a braking device that applies a brake to the main shaft connected to the driving shaft; and a housing-shaped side frame that accommodates the driving shaft and the swing shaft in an orientation in which each axial direction of the driving shaft and the swing shaft matches with a width direction, wherein the driving-force transmission mechanism includes a driving-force transmission shaft that is provided so as to protrude from a side wall of the side frame while extending parallel to the driving shaft within a space of the side frame and connected to the driving motor, and a transmission mechanism that connects the driving-force transmission shaft and the driving shaft so as to transmit rotation of the driving-force transmission shaft by the driving motor to the main shaft via the driving shaft, and the connection by the transmission mechanism is performed at a position between a connection position between the driving shaft and the swing mechanism and a connection position between the driving shaft and the main shaft, in the width direction.

2. The loom according to claim 1, wherein the transmission mechanism is a gear train including a driving gear attached to the driving-force transmission shaft and a driven gear attached to the driving shaft.

3. The loom according to claim 1, wherein the braking device is connected to the driving-force transmission shaft to apply a brake to the driving shaft via the driving-force transmission shaft.

4. The loom according to claim 2, wherein the braking device is connected to the driving-force transmission shaft to apply a brake to the driving shaft via the driving-force transmission shaft.

5. The loom according to claim 2, wherein the driving shaft is a crank-shaped shaft formed as an eccentric portion of which an intermediate portion is eccentric with respect to both side portions, and the swing mechanism is connected to the eccentric portion.

6. The loom according to claim 4, wherein the driving shaft is a crank-shaped shaft formed as an eccentric portion of which an intermediate portion is eccentric with respect to both side portions, and the swing mechanism is connected to the eccentric portion.

* * * * *